US010702063B2

(12) United States Patent
Rocklage et al.

(10) Patent No.: US 10,702,063 B2
(45) Date of Patent: Jul. 7, 2020

(54) FRAME FOR A DRAWER

(71) Applicant: PAUL HETTICH GMBH & CO. KG, Kirchlengern (DE)

(72) Inventors: Volker Rocklage, Bielefeld (DE); Anne Smollich, Halle (DE); Michael Schwarz, Minden (DE); Sebastian Poppendiek, Bunde (DE); Johann Friesen, Herford (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 0 days.

(21) Appl. No.: 16/325,481

(22) PCT Filed: Aug. 10, 2017

(86) PCT No.: PCT/EP2017/070294
§ 371 (c)(1),
(2) Date: Feb. 14, 2019

(87) PCT Pub. No.: WO2018/033465
PCT Pub. Date: Feb. 22, 2018

(65) Prior Publication Data

US 2019/0191878 A1 Jun. 27, 2019

(30) Foreign Application Priority Data

Aug. 15, 2016 (DE) ..... 10 2016 115084
May 11, 2017 (DE) ..... 10 2017 110286

(51) Int. Cl.
*A47B 88/00* (2017.01)
*A47B 88/925* (2017.01)

(52) U.S. Cl.
CPC ..... *A47B 88/925* (2017.01); *A47B 88/00* (2013.01); *A47B 2210/02* (2013.01)

(58) Field of Classification Search
CPC .. A47B 88/925; A47B 88/941; A47B 2210/02
See application file for complete search history.

(56) References Cited

U.S. PATENT DOCUMENTS 3,652,119 A * 3/1972 Hall ..... B60P 3/34 296/164
2006/0005502 A1* 1/2006 Bodingbauer ..... A47B 88/00 52/842

(Continued)

FOREIGN PATENT DOCUMENTS

DE 20203551 U1 5/2002
DE 202005008286 U1 10/2006

(Continued)

OTHER PUBLICATIONS

English Translation of Blum (DE20203551) (Year: 2019).*

(Continued)

*Primary Examiner* — Matthew W Ing
(74) *Attorney, Agent, or Firm* — Barnes & Thornburg LLP

(57) ABSTRACT

A frame for a drawer, which has an outer shell and an inner shell, wherein the outer shell is guided displaceably relative to the inner shell, in particular to a limited extent, wherein the outer shell and the inner shell are displaceably guided relative to one another at least to a limited extent with at least two sliding guides, and wherein at least one of the at least two sliding guides has one or more guide elements arranged between the outer shell and the inner shell.

23 Claims, 19 Drawing Sheets

(56) References Cited

U.S. PATENT DOCUMENTS

| | | | | |
|---|---|---|---|---|
| 2014/0285080 | A1* | 9/2014 | Feuerstein | A47B 88/941<br>312/330.1 |
| 2016/0007744 | A1* | 1/2016 | Fasino | A47F 3/06<br>312/330.1 |

FOREIGN PATENT DOCUMENTS

| | | |
|---|---|---|
| DE | 102010060722 | 5/2012 |
| DE | 102011050442 | 11/2012 |
| DE | 102015105131 | 10/2016 |
| EP | 1614369 | 1/2006 |

OTHER PUBLICATIONS

Search Report issued in German Appl. No. 10 2017 110286.8 (dated 2017).
Search Report issued in German Appl. No. 10 2017 110287.6 (dated 2017).
Search and Written Opinion issued in Int'l Appl. No. PCT/EP2017/070293 (dated 2017).
Search and Written Opinion issued in Int'l Appl. No. PCT/EP2017/070294 (dated 2017).
Office Action issued in U.S. Appl. No. 16/325,479 (dated Jun. 27, 2019).

* cited by examiner

FRAME FOR A DRAWER

CROSS-REFERENCE TO RELATED APPLICATIONS

This application is a U.S. nationalization under 35 U.S.C. § 371 of International Application No. PCT/EP2017/070294, filed 10 Aug. 2017, which claims priority to German Patent Application No. 102016115084.3, filed 15 Aug. 2016, and German Patent Application No. 102017110286.8, filed 11 May 2017. The disclosures set forth in the referenced applications are incorporated herein by reference in their entireties.

BACKGROUND AND SUMMARY OF THE DISCLOSURE

The present disclosure is directed to a frame for a drawer.

DE 10 2010 060 722 A1 disclosesa frame having a connecting fitting which is mounted with a base section on a frame adapter of a drawer frame or formed thereon. A release lever that can be operated manually is hinged to a locking lever and to the base section and extends into a free space in the frame adapter so that it can be operated manually by a user in the free space. The frame has proven itself well in practice, but requires a relatively large construction width.

The present disclosure is directed to a frame having a relatively slim design and inner and outer shells, wherein the inner shell and the outer shell may be shifted with respect to each other by simple means. the present disclosure also is directed to a drawer for a piece of furniture with one or more frames In an embodiment, a frame for a drawer comprises an outer shell and an inner shell, wherein the outer shell and the inner shell are guided displaceably relative to one another by at least two sliding guides, and wherein at least one of the at least two sliding guides comprises one or more guide elements arranged between the outer shell and the inner shell.

This makes it possible to easily design sliding guides between an inner shell and an outer shell that are adapted to the respective design conditions. For example, on inner and outer steel shells, sliding guides cannot be formed directly between the inner and outer shells, or only with great design effort. This problem is solved by the guide elements provided on the respective sliding guide. It is advantageous to attach the guide elements to the inner shell or the outer shell, for example, releasably, so that the corresponding component outer shell or inner shell can slide along them.

The frame may have a type of elongated shell-type housing at least with an outer shell and an inner shell, between which a cavity is formed which is thus easily accessible.

The term "sliding guide" means that a first element is slidably guided on a second element and slides directly or indirectly on the second element. The sliding guide can, for example, be formed by a web of an element which slides on two or three sides, for example in a corner area or in a guide groove of a corresponding element. The guide groove can be formed directly in the inner or outer shell or in another guide element attached to it.

In an embodiment, the at least two sliding guides provide a linearly limited displacement of the outer shell relative to the inner shell, which may be sufficient to allow sufficient access to the interior space between the inner shell and the outer shell.

In an embodiment, the outer shell and/or the inner shell may beformed from one or more steel elements, for example, steel sheets. In other embodiments, the inner and outer shells may be made of other materials, such as light metal, for example, aluminum. Unlike extruded profiles, webs or grooves cannot be easily formed on steel sheets. Accordingly, such features may be provided by the guide elements.

In order to realize good sliding properties and to provide the guide elements with suitable geometry and shape in a simple way, the guide elements may be made of plastic.

In an embodiment, one of the sliding guides is designed as an upper sliding guide and at least one other of the sliding guides is designed as at least one lower sliding guide between the inner shell and the outer shell, wherein at least the upper sliding guide and/or the at least one lower sliding guides each have one or more of the guide elements arranged between the outer shell and the inner shell. In this case, the terms "lower" and "upper" refer to a vertical direction in an installation position of the frame on a drawer to a lower installation position closer to the drawer bottom and to an upper installation position further away from this drawer bottom.

in an embodiment, the guide elements are each arranged in a receiving channel formed between the inner shell and the outer shell. The receiving channel may be formed by at least three or four walls, wherein at least one wall projects above the guide elements in its height. Two walls extending almost parallel to each other in vertical alignment with the drawer bottom may have the same height. In this way, the guide elements are well protected and are visually concealed (with regard to the position of use of the drawer with a frame on a piece of furniture according to the invention) from the outer shell and the inner shell in the respective receiving channel.

In an embodiment, two of the walls of at least one receiving channel are formed by the inner shell and if one of the walls of the receiving channel is formed by the outer shell. The upper guide elements may be attached to the inner shell so that the outer shell is guided by the upper guide elements.

in an embodiment, each of the guide elements may be fastened to the inner shell or to the outer shell and if the corresponding element—the outer shell or the inner shell—has a guide groove which corresponds to the guide element and in the area of which the outer shell or the inner shell is slidably guided on the guide element or elements.

In an embodiment, the frame has two different lower sliding guides between the inner shell and the outer shell, and both of the lower sliding guides each have one or more of the guide elements arranged between the outer shell and the inner shell. In this way, limited mobility can be achieved in the lower area between the inner shell and the outer shell, which is sufficient to allow access to functional elements in the interior space between the inner shell and the outer shell. In addition, it is thus possible to position the outer shell and the inner shell very precisely relative to each other.

in an embodiment, the guide elements of each of the sliding guides maybe fastened to the inner shell and/or to the outer shell.

In an embodiment, the guide elements engage displaceably in a guide groove of the respectively corresponding element of the outer shell or inner shell.

In an embodiment, at least two different types of upper guide elements may be provided for the upper sliding guide, which can be interchangeably attached to the inner or outer shell. For example, by replacing the guide elements and, for example, one of the shells, especially the outer shell, different variants of frames can easily be produced in order to produce different variants or also to enable a frame to be retrofitted.

in an embodiment, one or more sliding and/or positioning means for fastening and/or positioning a top element are formed on one or more of the upper guide elements. In this way at least one upper guide element may perform multiple functions, e.g. for arranging at least one angular element.

For example, sliding guide means may be provided on one or more of the upper guide elements, on which a cover strip with corresponding sliding guide means is slidably guided. The upper guide elements may thus be used both for the function of the sliding guide between the inner and outer shell and for the realization of other frame variants with a cover strip, with which, for example, other colors or shapes can be realized on the frame.

In an embodiment, sliding guide means may be formed on the upper guide elements, on which the cover strip is slidably guided with corresponding sliding guide means. In this way, two sliding guides are formed simultaneously on the upper guide rails. On the one hand this is the sliding guide between the inner and outer shell and on the other hand it is a sliding guide for the cover strip relative to one of the elements inner and outer shell.

In an embodiment, the sliding guide means may form a tongue-and-groove sliding guide in their interaction.

In an embodiment, two different types of lower guide elements may be distributed between the inner shell and the outer shell on at least one lower sliding guide or on the two lower sliding guides, one of which is associated with the first lower sliding guide and the other of which is associated with the second lower sliding guide. In such an embodiment, various additional functionalities can be realized with the different types of guide elements.

In an embodiment, at least one type of lower guide means may be arranged in front and/or rear end regions of the frame between the inner shell and the outer shell in each case, in order to guide the inner shell and the outer shell well in these two regions as well and preferably to keep them at a relatively precise distance and to secure them in the end regions of the frame against being pulled apart beyond the designed displacement path.

In this respect, one type of the lower guide element may be fixed to the inner shell and slidably guided directly or indirectly on the outer shell and the other type of lower guide element may be fixed to the outer shell and slidably guided directly or indirectly on the inner shell.

With regard to the assembly of the guide elements, at least some of the lower and/or upper guide elements may be fixed to the inner shell or the outer shell in a latching manner.

The first type of lower sliding guide means can be fixed to the inner shell or to the outer shell, for example, by a joining forming process. The sliding guides can also be used to make it easier to assemble the frame and to hold one shell to the other in a simple way. This type of fastening can be achieved easily and without additional components in a confined space, so that the use of the joining forming process as a suitable manufacturing process opens up a possibility for reducing the overall width of the frame.

The upper and lower guide elements can be identical or different in design.

In an embodiment, the upper and/or lower guide elements as a whole may be attached to the inner or outer shell. In other embodiments, some of the guide elements may be fixed to the inner shell and some of the guide elements may be fixed to the outer shell.

In an embodiment, frames can be realized in which the inner and/or outer shell, preferably made of sheet steel, together form an essentially rectangular body with a maximum width $B_3$ of less than 15 mm.

DETAILED DESCRIPTION OF THE DRAWINGS

Figure 1:
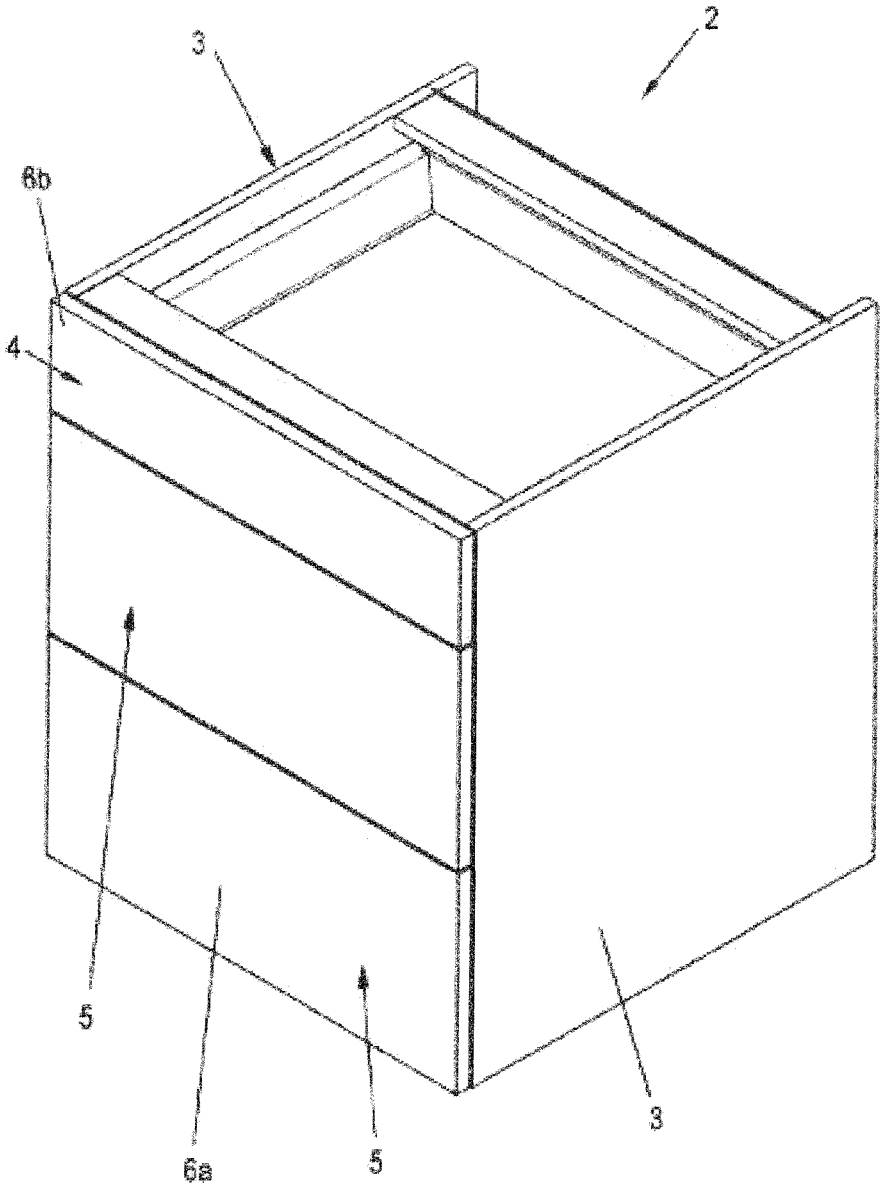
FIG. 1: shows a spatial view of a cabinet with three drawers that are in the closed state.

FIG. 1 shows a piece of furniture designed as cabinet furniture 2. The cabinet furniture 2 has a furniture body 3.

Three drawers 4, 5 are inserted here into the furniture body 3—just as an example. The drawers 4, 5 are slidably guided in the furniture body 3 so that each of the drawers 4, 5 can be pulled out of the furniture body 3 into an open position and pushed back therefrom again into a closed position.

Figure 2A:
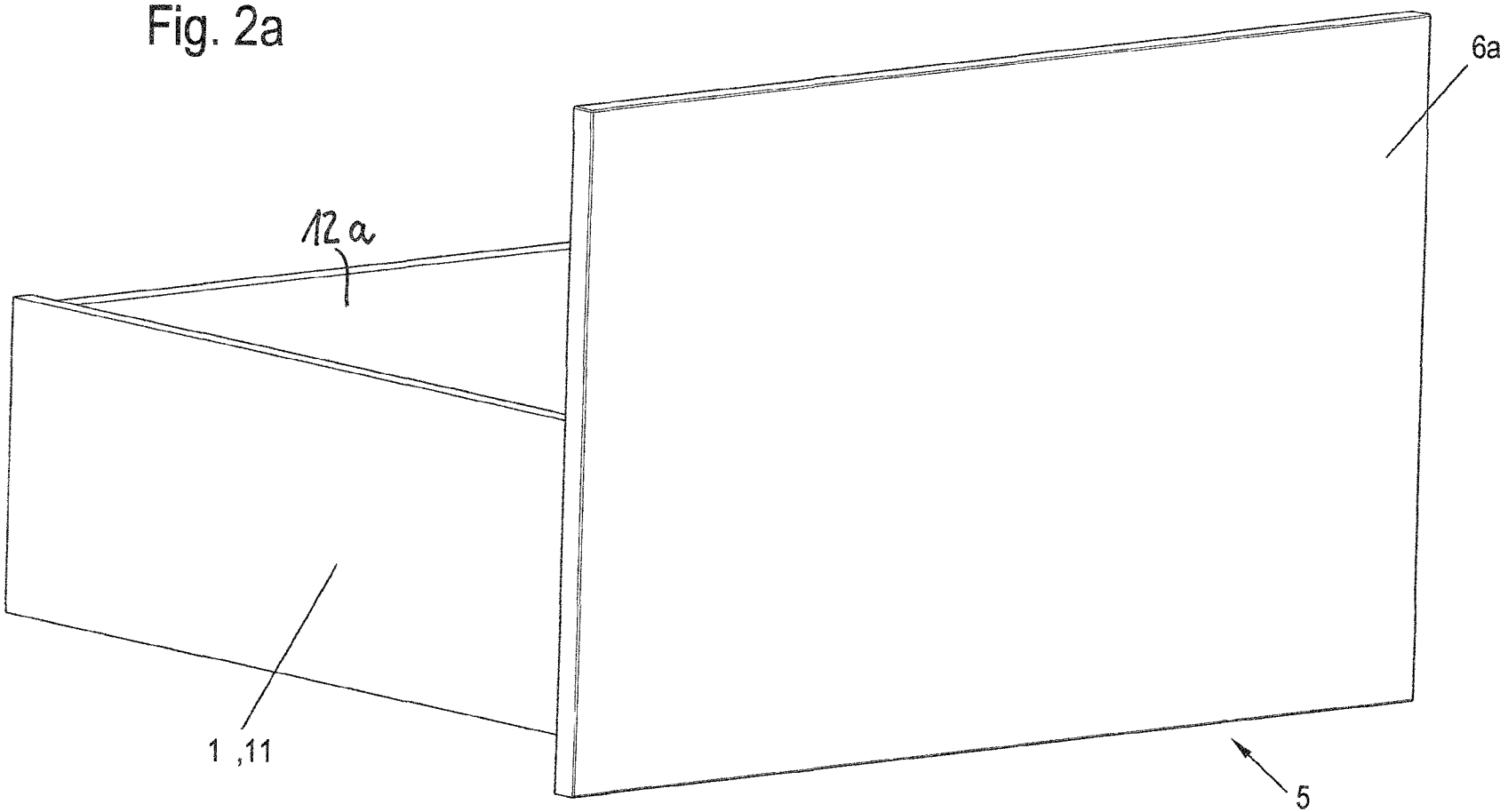
FIG. 2*a*: shows a spatial view of one of the drawers from FIG. 1, having a front panel and (side) frames, one of which is recognizable.

The drawer 5 illustrated in FIGS. 2*a* and *b* has a front panel 6*a*, which here is designed as a relatively high front panel 6*a* as an example. Drawer 5 also has two side frames—hereinafter also referred to as frames 1. The frames 1 are preferably constructed with two shells. The frame has an elongated shell-like housing with an outer shell 11 and an inner shell 10.

In this case, the outer shell 11 is held on the inner shell 10 and can be moved relative to it. In an embodiment, the outer shell is held on the inner shell so that it can be moved to a limited extent. The inner shell 10 comprises in each case a narrow cavity with the outer shell 11.

The terms inner shell 10 and outer shell 11 do not mean that they have to be constructed in one piece. The inner shell 10 and the outer shell 11 can in turn be composed of several elements, such as metal strips that interact to form the inner shell and the outer shell 10, 11.

Drawer 5 also has a rear panel 12*a* and a drawer bottom 12*b*. Preferably—but not necessarily—the outer shell 11 and the inner shell 10 are made of sheet metal, especially sheet steel. However, they can also consist of other materials. In an embodiment, the inner shell 10 and the outer shell 11 are each manufactured in one piece or in several pieces from one or more sheet(s), for example, of steel, aluminum, or another material, which have been bent over to form sections and on which, if necessary, recesses and the like are formed by punching, cutting or the like.

Figure 2B:
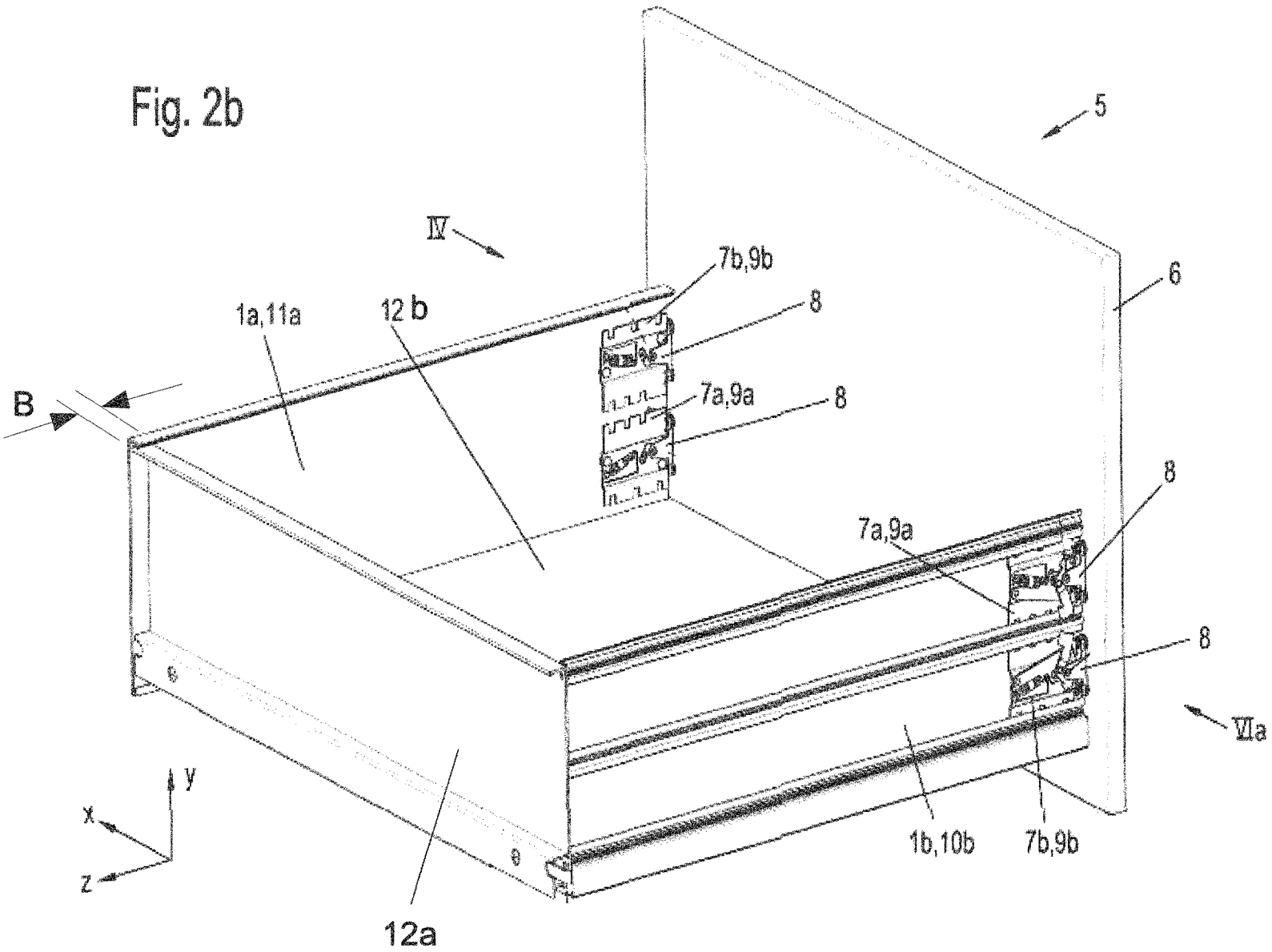
FIG. 2*b*: shows a spatial view of the drawer from FIG. 2*a*, wherein, in respect of the frame visible on the left by the drawer operator, one outer shell of the frame is not shown and, in respect of the frame visible on the right by the drawer operator, the inner shell of the other frame is not shown.
Figure 3A:
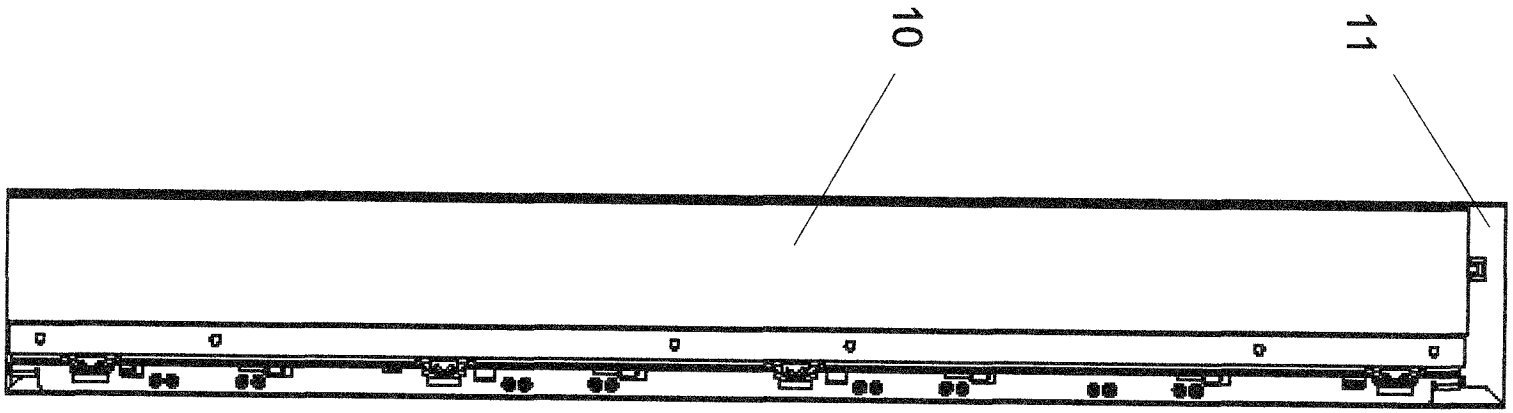
FIG. 3 shows in a) a front view of a frame with a two-part shell, in b) a side view of the frame from a) with functional elements arranged in the shell and in c) an exploded view of the shell from a) and b)

In an embodiment, the outer shell 11 and the inner shell 10 form a frame with a relatively small, i.e. "narrow" construction width, which (perpendicular to FIG. 3*a*) may be less than 15 mm, or less than 12 mm. FIG. 2*b* does not show the outer shell 11 of the left frame 1 of drawer 5 as seen by the operator of the drawer 5 and the inner shell 10 of the right frame 1 as seen by the operator of drawer 5.

Several functional devices are arranged on each of the frames 1, which are essentially arranged in the installation space between the outer shell 11 and the inner shell 10. These functional devices include, for example, one or more locking devices and one or more fastening elements. The drawer in the area of each of the two frames 1 has at least one, here two connecting fittings 7*a*, 7*b*, with each of which the front panel 6*a* can be attached to the frame.

For this purpose, the front panel 6*a* of each connecting fitting 7*a*, 7*b* can be connected or is connected in the assembled state to a corresponding locking device 9*a*, 9*b* on the corresponding frame 1 on the left or right via a carrying device 8.

Drawer 4 with low front panel 6*b* has the same design as drawer 5 with high front panel 6*a*. Differences between the two drawers 4, 5 exist in particular in the height of the front panel 6*a* or 6*b* (and possibly the rear panel) and thus in the height of the frames 1, which are formed in a correspondingly lower manner in the case of drawer 4 with a low front panel 6*b*. As a result, frames 1 of the drawer 4 with low front panel 6*b* may have only one locking device 9*a* or 9*b*.

Figure 16:
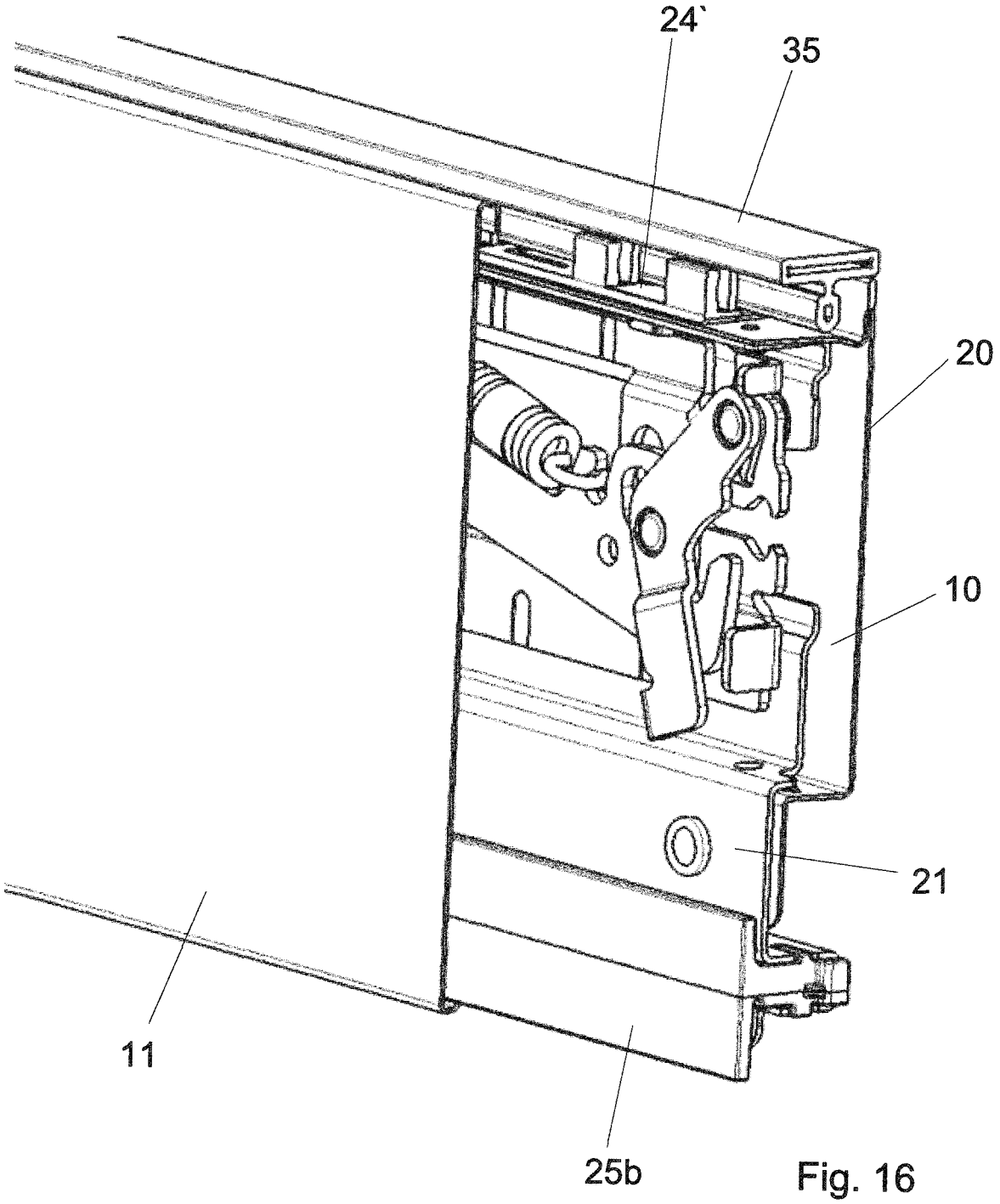
FIG. 16 shows a perspective view of the frame from FIG. 15 with a three-part shell with an inner shell displaced relative to the outer shell.
Figure 17:
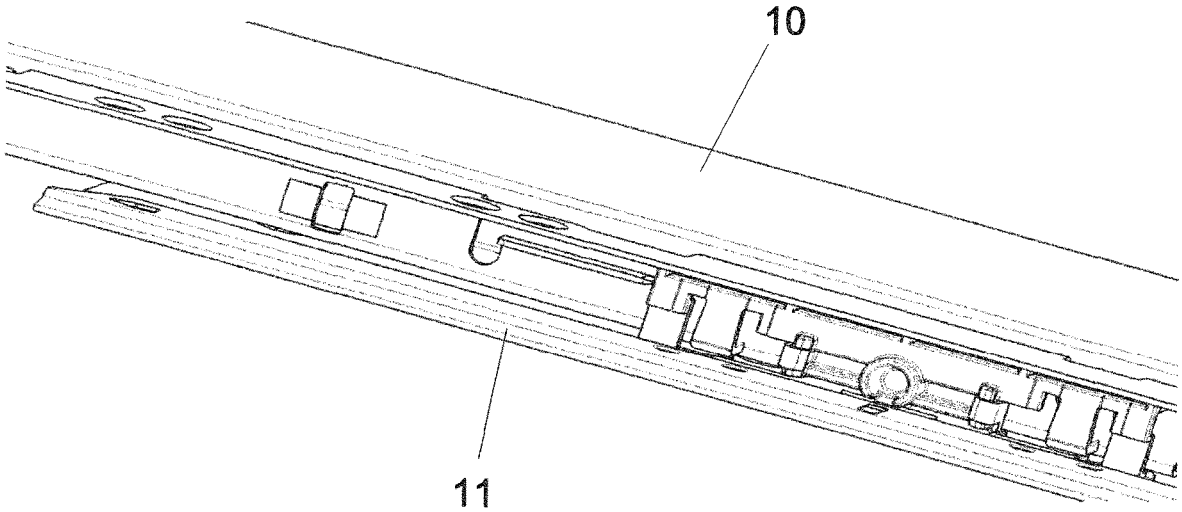
FIG. 17 shows a further perspective view of a partial area of the arrangement from FIG. 16.

In order to provide access to the functional element(s) located wholly or partially in the intermediate space between the inner shell 10 and the outer shell 11, the inner shell 10 may be displaceable relative to the outer shell 11. Such displacement may be limited (for illustration see for example FIG. 16).

In an embodiment, the outer shell 11 is designed in one piece. The outer shell 11 also has an outer wall section 13, which essentially or completely forms the visible outer wall of the frame 10 on the outer wall/side facing away from the drawer bottom 12*b*. Towards the rear panel 12*a*, the inner shell 11 here is shorter by the width B of the rear panel than the outer shell 11.

Figure 3B:
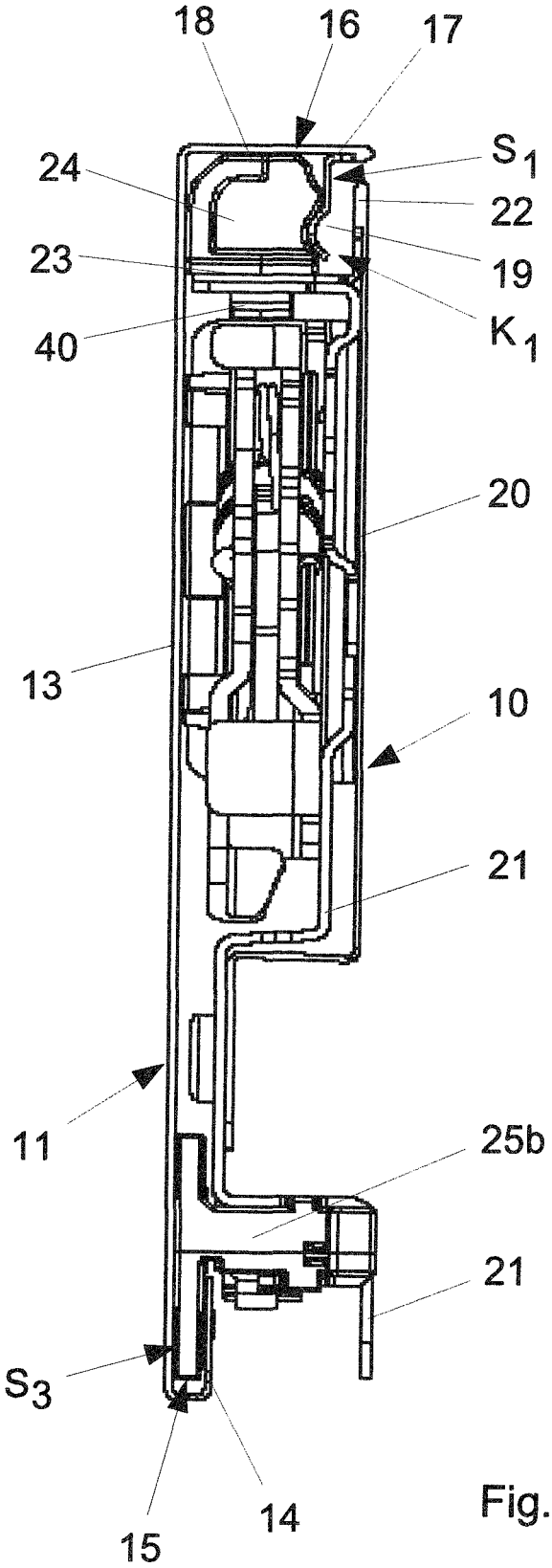

In an embodiment, a lower edge 14 of this outer wall section 13 is bent 180° towards the inner shell 10. A channel-like lower guide groove 15 is formed on the outer shell 11 (FIG. 3*b*).

Furthermore, an upper edge 16 of this outer wall section 13 may be bent by a total of approx. 180° towards the inner shell 10, so that also a channel-like upper guide groove 17 is formed. Here the upper guide groove 17 is wider than the lower guide groove 15.

The upper edge 16 here also forms a cover strip section 18 at an angle to the outer wall section 13, which closes off the outer shell 11 at the top. For this purpose, the cover strip section 18 may be bent by 90° relative to the outer wall section 13. The upper edge 16 may form a resiliently acting angulation 19 (in a manner yet to be explained) which extends downwards from the cover strip section 18. Thus the upper edge 16 together with the cover strip section 18 and the angulation 19 may jointly form the upper channel-like guide groove 17 on the outer shell 11.

In an embodiment, the inner shell 10 is designed in two pieces. However, it can also be formed in one piece or consist of more than two metal sheets (not shown here). Here the inner shell 10 has an inner wall section 20 and a container rail 21 attached to the inner wall section 20 with one or more attachment points, wherein these points can be produced by joining methods such as riveting, clinching or welding.

One or more of the functional elements described above is/are defined on the container rail 21. It increases the stability of the respective frame 1 and simplifies assembly.

The inner wall section 20 serves, among other things, to optically cover frame 1 towards the inside—i.e. towards the drawer bottom 12*b*.

The upper edge 22 of the inner wall section 20 (and here also that of the container rail)—see FIG. 3*b*—is bent outwards or towards the outer shell 11 in such a way that it lies below the upper guide groove 17 and forms a carrying leg 23 there in the manner of a cross beam. Between the carrying leg 23 and the inner and outer shells 10, 11, an upper receiving channel K1 is thus formed towards the upper edge area.

The carrying leg 23 is used here to fasten one or more first—upper—guide elements 24. These are arranged in the upper receiving channel K1 and are well protected and optically concealed there. The outer shell 11 glides on them. They therefore form a first, upper sliding guide S1 with the outer shell 11 (see FIG. 3*b*).

Preferably several of the upper guide elements 24 are distributed in a row at a distance from each other on the carrying leg 23 of the inner shell 10. The carrying leg 23 and an adjoining wall area of the inner shell 10 form two of the walls of the upper receiving channel K1. Two other walls of this receiving channel K1 form the outer shell 11. The upper receiving channel K1 is thus closed all around. The upper guide elements 24 are therefore not visible from the outside in their installation position on a drawer.

Figure 3C:
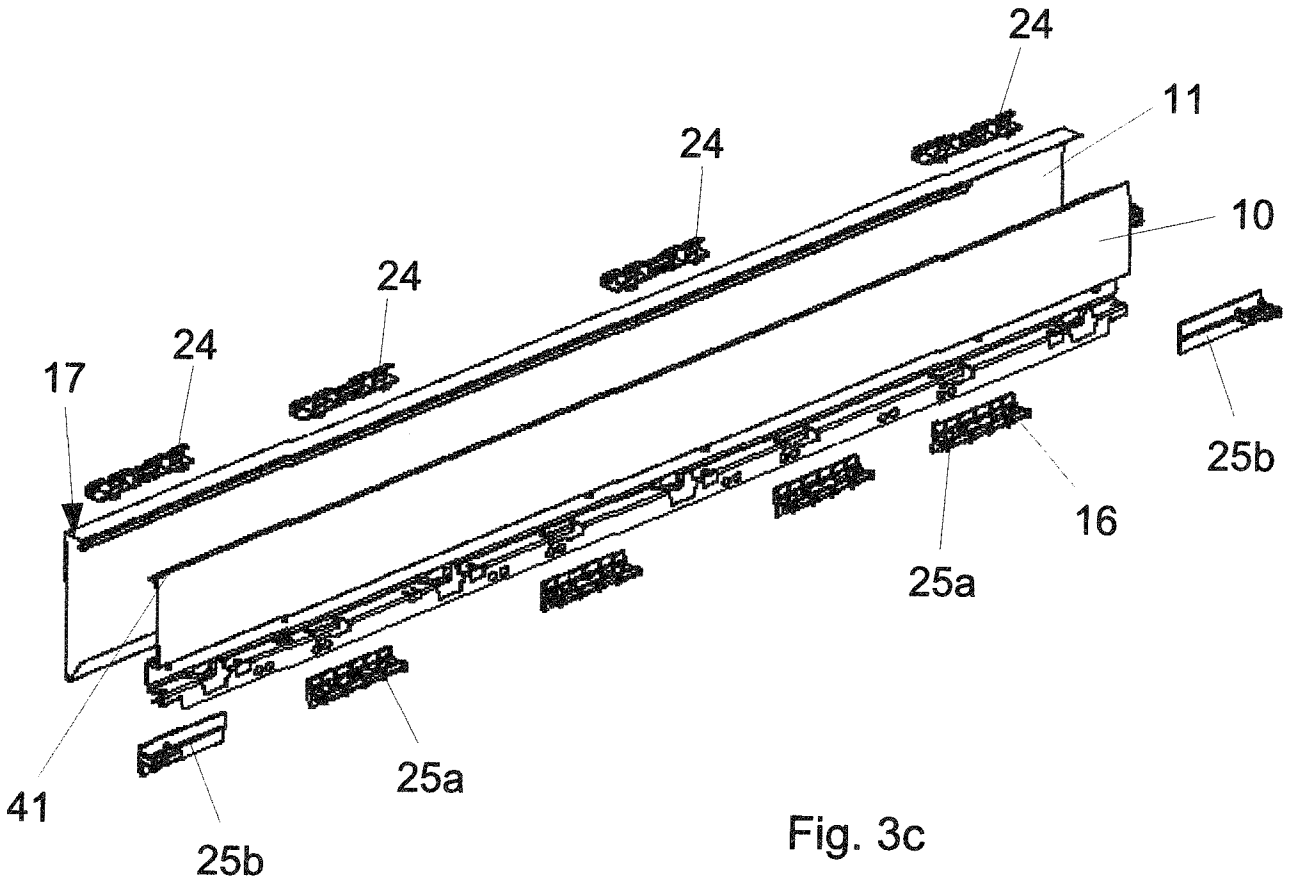

The guide elements 24 can be fixed in a stationary manner in the receiving channel K1, for example, with screws or rivets and/or locking means or the like. In an embodiment, such fastening may be made using at least one detent hook 40 or more detent hooks, which engages/engage into a detent recess 41 of the carrying leg 23 and/or the container rail 21 (FIGS. 3*b* and 3*c*).

The upper (and also the further) guide elements 24 each form sliding elements, wherein according to FIG. 3*b* the upper guide elements engage directly into the upper guide groove 17 of the displaceable outer shell 11. In this case, the resilient leg 19 rests laterally on the guide elements 24 in a resilient manner. In this way, the outer shell 11 is guided in a simple way in the upper area on the guide elements 24 of the inner shell 10 so that it can be moved easily and safely. The first—upper—sliding guide S1 is formed between the outer shell 11 and the inner shell 10.

Since the angulation 19 is preferably designed as a resilient leg, which laterally engages resiliently in a lateral recess 24*a* of the upper guide elements 24, a particularly good fit of the outer shell 11 in this area is achieved on the guide elements 24. In this way, a lift-off safety device of the outer shell 11 from the inner shell 10 can be easily implemented.

Figure 20:
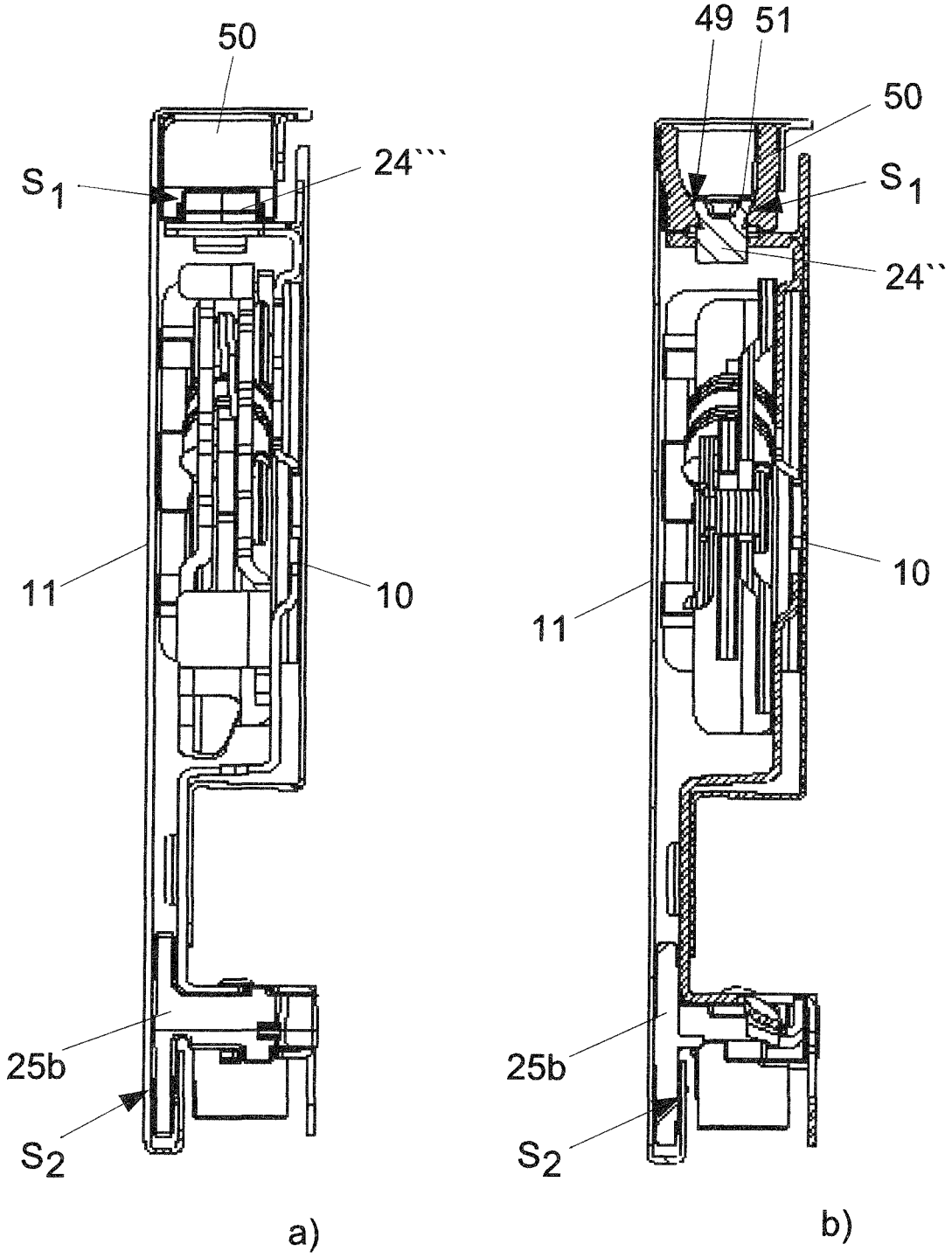
FIG. 20 shows in a) a side view and in b) a section through a variant of a frame of the type shown in FIG. 3*b*.

The lift-off safety device can also be implemented in other constructive ways. Reference is made for this purpose to FIGS. 20 *a*) and *b*). Here the upper guide element 24" does not engage directly in a guide groove in the outer shell 11 (e.g. here in the guide groove 17) but in a guide groove 49, which is arranged in a further guide element 50 which is mounted on the outer shell 11. Here the further guide element 50 is provided with the guide groove 49, in which an upper guide web S1 of the guide element 24" fixed to the inner shell engages. The other upper guide element 50 is arranged in the guide groove 17 and is fixed (not visible here).

Thus, on the one hand, the upper sliding guide S1 between the inner shell 10 and the outer shell 11 is implemented constructively by simple means with two guide elements 24",50, of which one is provided on the outer shell 11 and the other on the inner shell 10.

In addition, since the guide web 51 and the guide groove 49 engage behind each other, here in the manner of a dovetail guide, a variant of a device to secure the outer shell 11 against lifting off from the inner shell 10 is also implemented in a simple manner.

This one or the multiple upper guide elements 24, 24" (and 50) may consist of a plastic material. The latter also applies to further guide elements 25*a*, 25*b* to be explained.

In addition, the outer shell 11 is also displaceably guided further down—here at the lower edge—towards the inner shell 10 with further guide elements 25*a, b* relative to the inner shell 10.

Figure 5A:
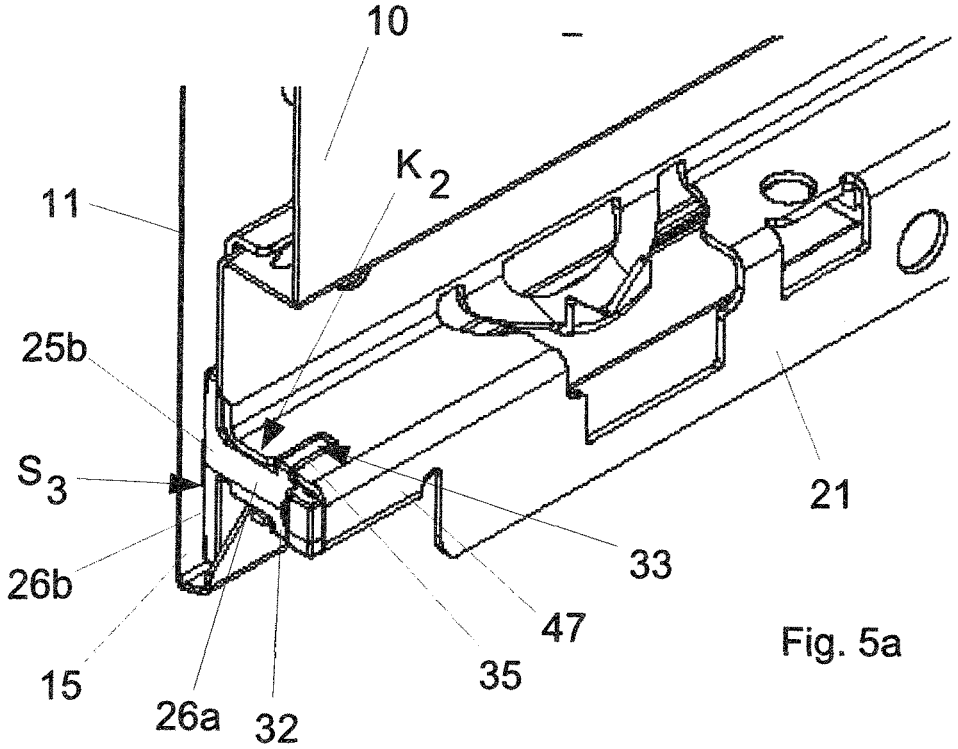
FIG. 5 shows in a) and b) different perspective views of sections of a frame with a guide element of the type shown in FIG. 4, and in c) and d) a side view and a front view of the section from a).

In this area further down, at least one further sliding guide S2 is formed between the inner shell 10 and the outer shell 11. Preferably, even two further lower sliding guides S2 and S3 are provided (FIG. 3*b* and FIG. 5*a*).

It is conceivable to provide only one type of lower guide element. According to the figures shown, on the other hand, two different types of lower guide elements are provided which are designated 25*a* and 25*b* in the drawings and which are optimally adaptable or adapted in each case to the tasks and geometries in the area of the two lower sliding guides S2, S3.

The first lower guide elements 25*a* are preferably fixed to the outer shell 11 of the lower guide groove 15 using a forming process, for example, in such a way that the joining process leaves no visible traces from the outside. They serve as combined guide and fixing elements and also serve to hold the outer shell 11 on the inner shell 10. The lower middle guide elements 25*a* engage advantageously with a vertically aligned guide leg 26*b* fixedly and immovably in the lower groove 15 of the outer shell 11.

Figure 11:
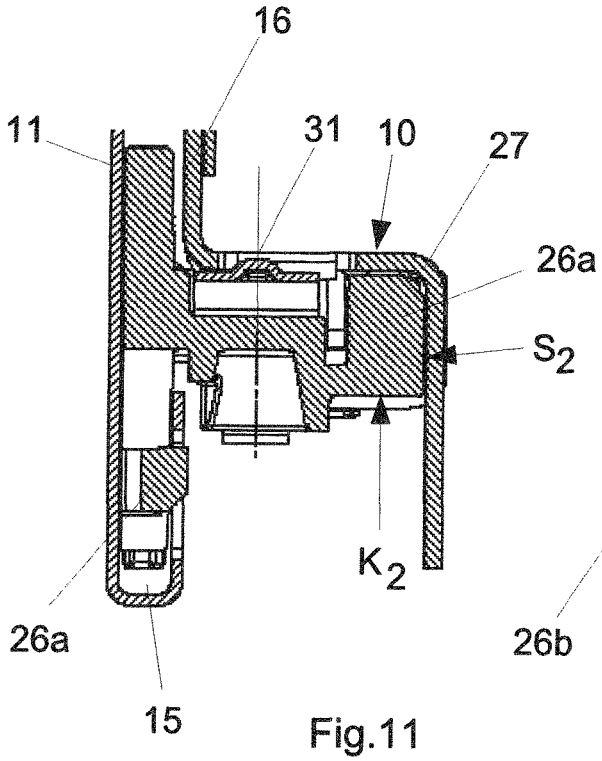
FIG. 11 shows a sectional view through a section of a frame of the type of FIGS. 1 to 3 and 5 having a guide element of the type of FIG. 10.
Figure 10:
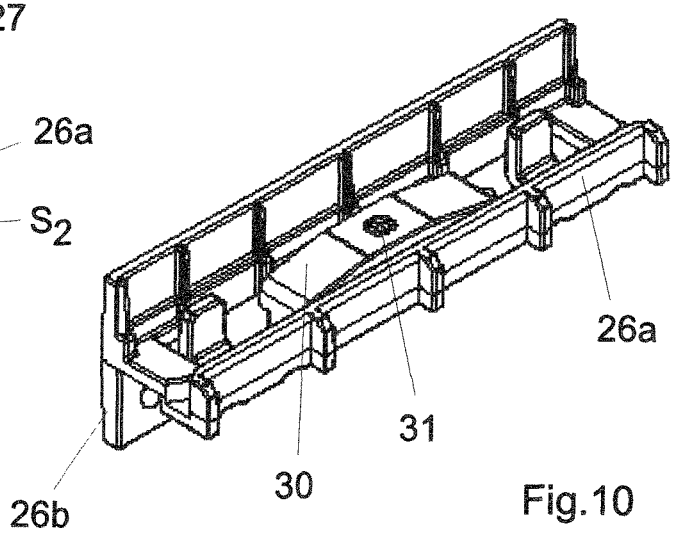
FIG. 10 shows another lower guide element—second type—for a frame, especially in the manner of the preceding figures.

According to FIG. 3*c*, four of these first lower guide elements 25*a* are provided as examples. They preferably have a T-shape in section (see FIGS. 10 and 11). The preassembled guide elements 25*a* on the outer shell 11 carry a horizontally aligned cross beam 27 of the inner shell 10 with a horizontally aligned leg 26*a* after the inner shell 10 has been placed on it. Said cross beam 27 limits a lower receiving channel K2 for the lower guide elements 25*a, b* upwards. The one other wall of this receiving channel K2 is formed by the outer shell 11 and the other by the inner shell 10. Since the middle lower guide elements 25*a* are attached to the outer shell 11, the actual sliding guide S2 is formed on these guide elements 25*a* towards the inner shell 10, here on the container rail 21.

The lower middle guide elements 25*a* are thus advantageously positioned between the inner shell 10 and the outer shell 11, where they are concealed and well protected.

Figure 12:
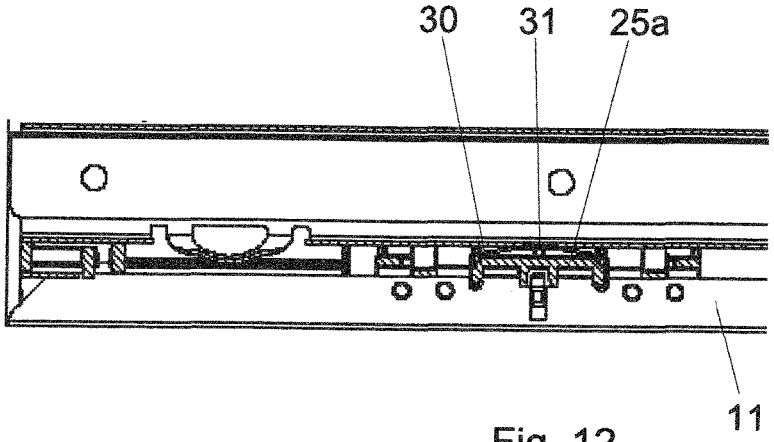
FIG. 12 shows the guide element from FIGS. 10 and 11 on a section of the frame of FIG. 11.

At least one of the central (first lower) guide elements 25*a* secured to the outer shell has a spring element 30—adapted to engage a window or the like of the inner shell upon displacement of the outer shell 11 relative to the inner shell to releasably secure the outer shell 11 relative to the inner shell 10 in a final assembly position which can only be released in a special case such as a maintenance case. Here the spring element 30, in particular a leaf spring, has a detent lug 31, which engages in a latching manner in a window of the inner shell when the outer shell 11 is moved (see FIGS. 10 to 12).

There are also two outer guide elements 25*b*—see FIGS. 4 to 8—which are each provided in the end area (i.e. towards the front panel and towards the rear panel) of frame 1.

These outer guide elements 25*b* stabilize in particular the outer end areas of the frame in the end area of the inner shell 10 and the outer shell 11. They are also arranged in the lower receiving channel K2. However, they are fixed to the inner shell 10 and the outer shell 11 is movable relative to or on them.

The outer guide elements 25*b* each may have a detent means such as a detent hook 28, which is/are attached to a corresponding detent means—for example to a window 29 of the inner shell 10.

Also the two outer lower guide elements 25*a, b* may be T-shaped in section, so that three legs 26*a, b, c* are formed on them.

The horizontal leg 26*a* has the detent hook 28 and is fixed to the inner shell 10, namely in a receptacle 47 which is U-shaped in cross-section and formed in the end area of the inner shell 10. The lower vertical leg 26*b*, on the other hand, engages in the guide groove 15 of the outer shell 11, which is open vertically upwards, and is slidably guided there.

Figure 5B:
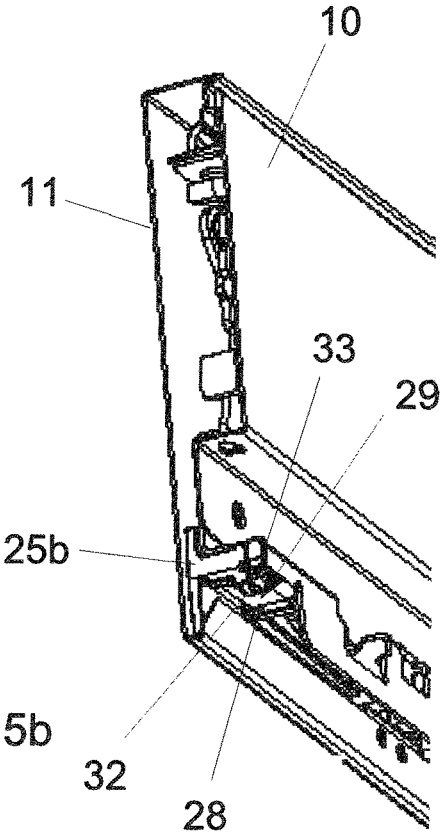
Figure 4:
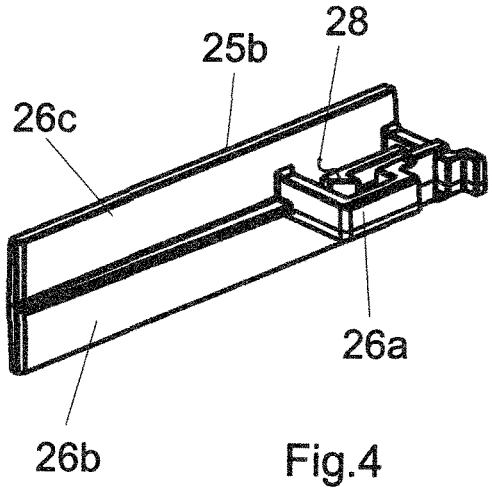
FIG. 4 shows a perspective view of a preferred embodiment of a lower guide element of the first type for a frame, which, for example, is designed according to FIGS. 1 and 2.
Figure 5C:
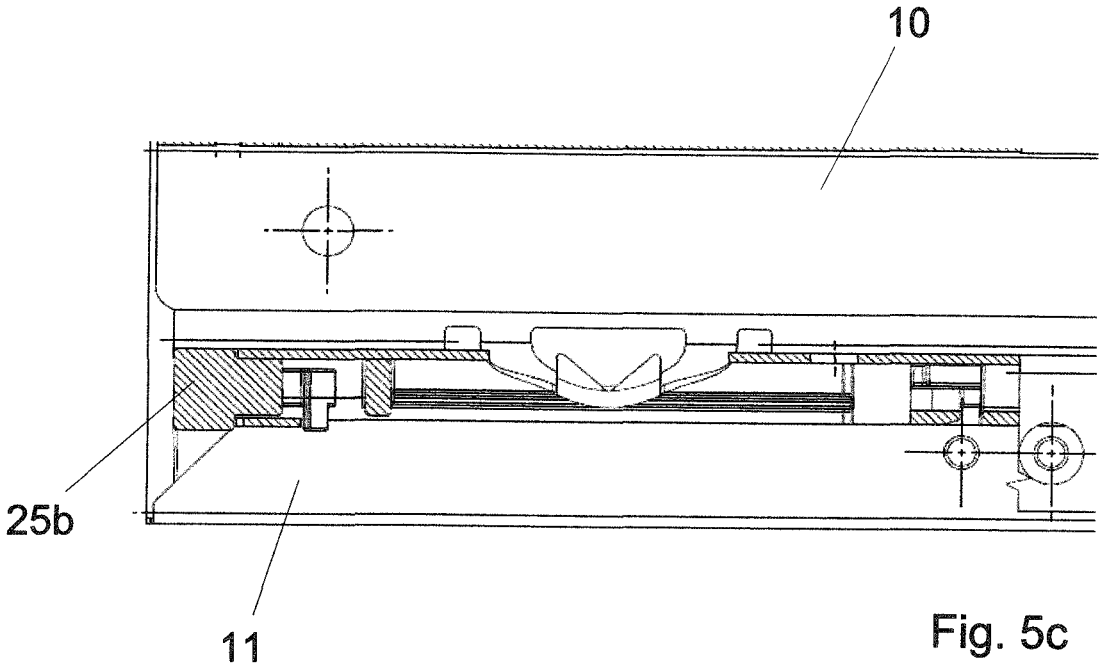
Figure 5D:
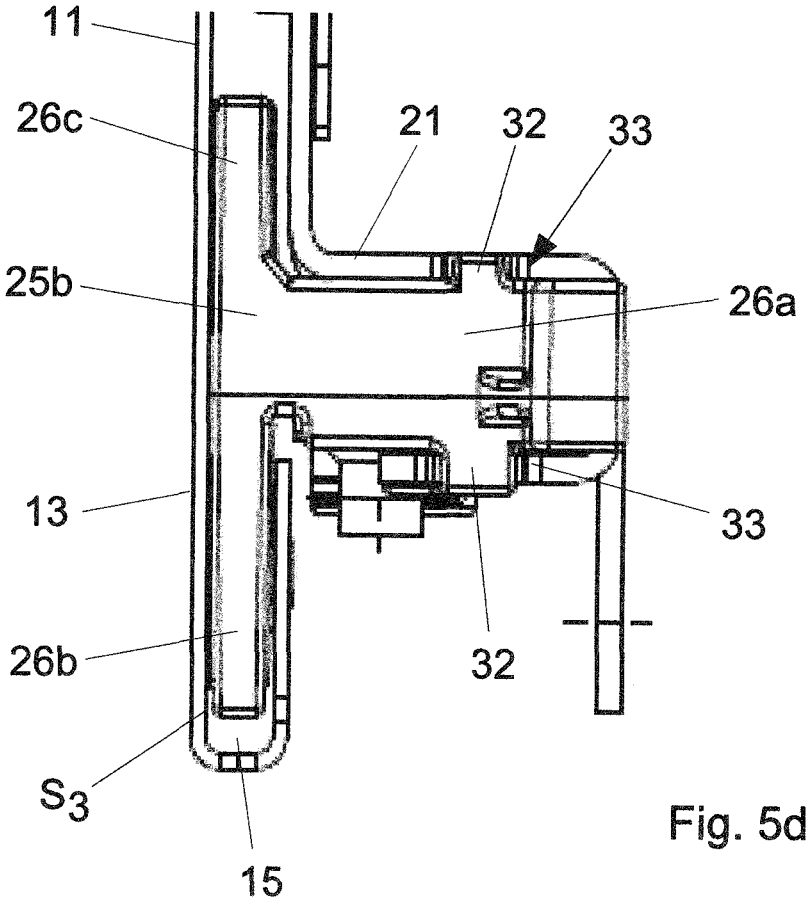
Figure 9:
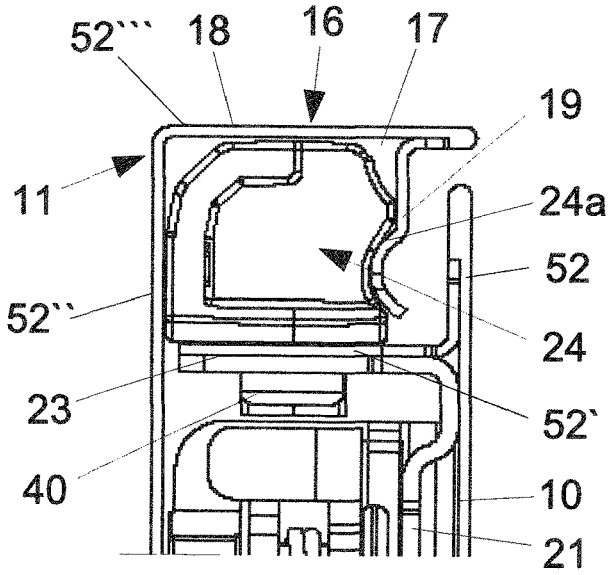
FIG. 9 shows a side view of a section of a frame with the upper guide element.
Figure 8:
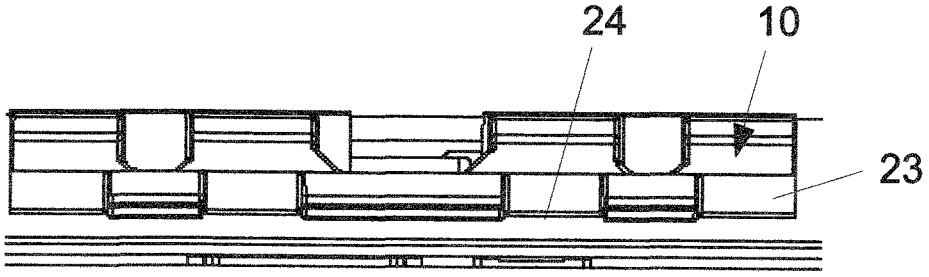
FIG. 8 shows a front view of an upper guide element on the frame FIGS. 1 to 3 and 5.
Figure 6:
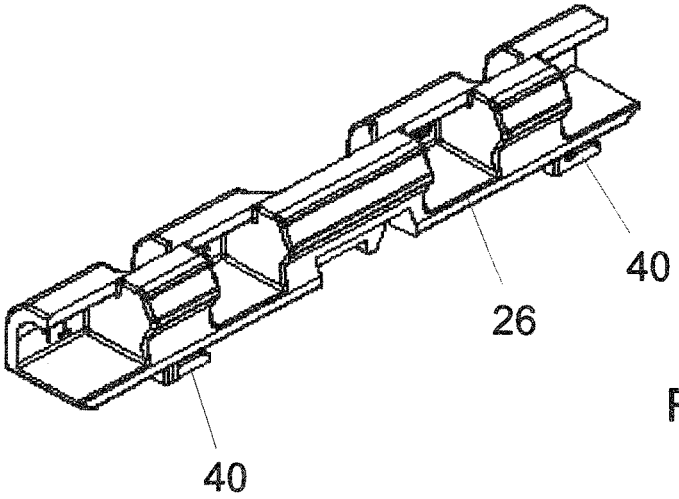
FIG. 6 shows a perspective view of an embodiment of a second—upper—guide element for a frame, which is designed for example according to the type of FIGS. 1 and 2.
Figure 7:
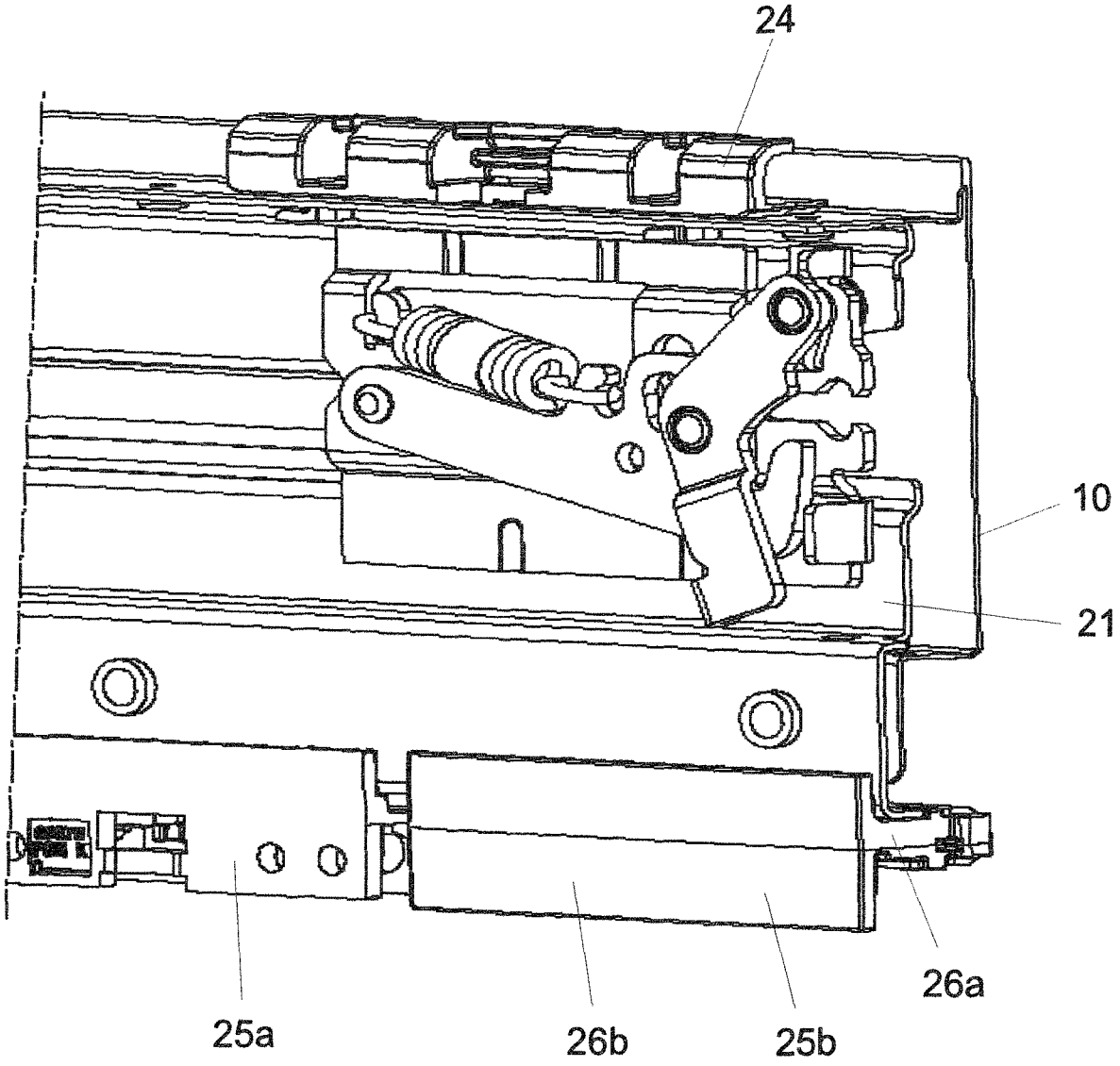
FIG. 7 shows a perspective view of an end region of the frame from FIGS. 1 to 3 and 5.

Short vertical webs 32 of the guide elements 25*b* engage in slots 33 of the cross beam 27 of the inner shell 10 and thus additionally secure the edge area of the frame against pulling apart the outer shell 11 and the inner shell 10 (see in particular also FIG. 5*b*).

The lower vertical leg 26*b* of these outer guide elements 25*b*, which form a second type of lower guide elements, engages in the lower guide groove 15 of the outer shell 11. In this way, the third lower sliding guide S3 is easily formed.

The two sliding guides S2 and S3 thus allow only limited displaceability corresponding to the distance between the two guide elements 25*a, b* of different type. However, this is sufficient to provide access to the functional devices described above in the interior space between the inner shell 10 and the outer shell 11 (see again FIG. 16).

In total, with the two types of lower guide elements 25*a* and 25*b*, two different lower sliding guides S2, S3 are formed between the outer shell 11 and the inner shell 10, which allow at least a limited displacement until the guide elements 25*a, b* abut each other.

The first guide elements 25*a* may be fixed to the outer shell 11 at its guide groove by a forming process, preferably in such a way that the joining process leaves no visible traces on the opposite side of the outer shell "on the outside".

According to FIG. 3*c*, four of the middle guide elements 25*a* of the first type are provided as examples. In addition, two of the outer guide elements 25*b* of the second type are provided, which are each provided in the end area (i.e. towards the front panel and towards the rear panel) of frame 1. These outer guide elements 25*b* in particular stabilize the outer end regions between the inner shell 10 and the outer shell 11. The outer guide elements 25*b* may each have a detent means such as a detent hook 28, which is/are fastened to a corresponding detent means—for example to a window 29 here on the (continuously or sectionally provided) guide groove 15 of the outer shell 10.

All lower guide elements 25*a, b* may be T-shaped in section, so that three legs 26*a, b, c* are formed on them, which can engage in corresponding grooves of the outer shell 11 and or the inner shell 10.

Figure 13:
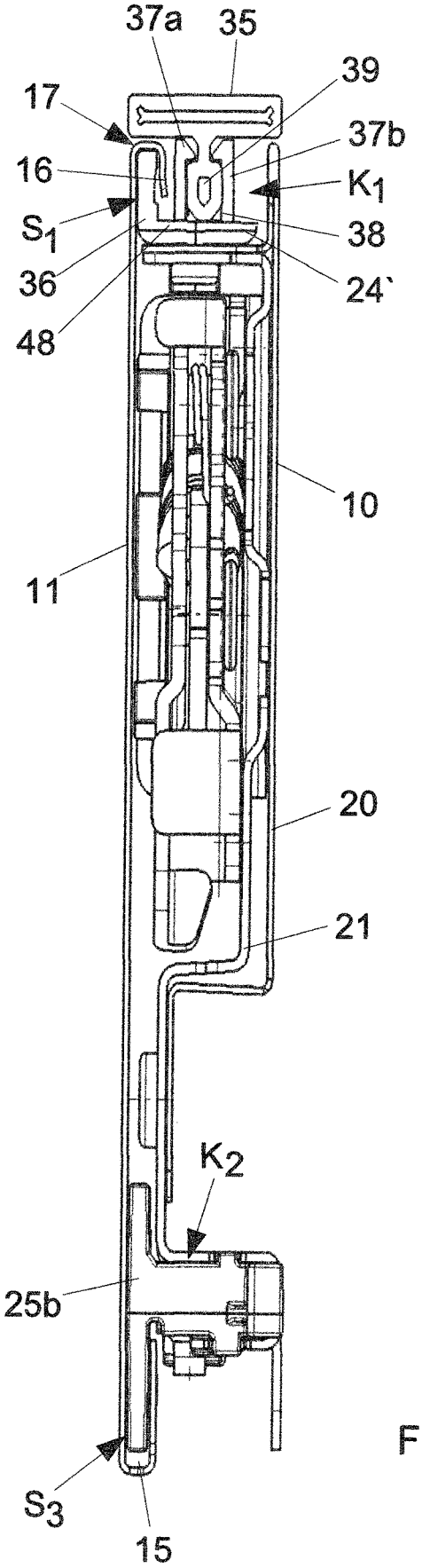
FIG. 13 shows a side view of a further frame with a three-part structure having inner shell, outer shell and cover strip, wherein upper and lower guide elements are provided.
Figure 14:
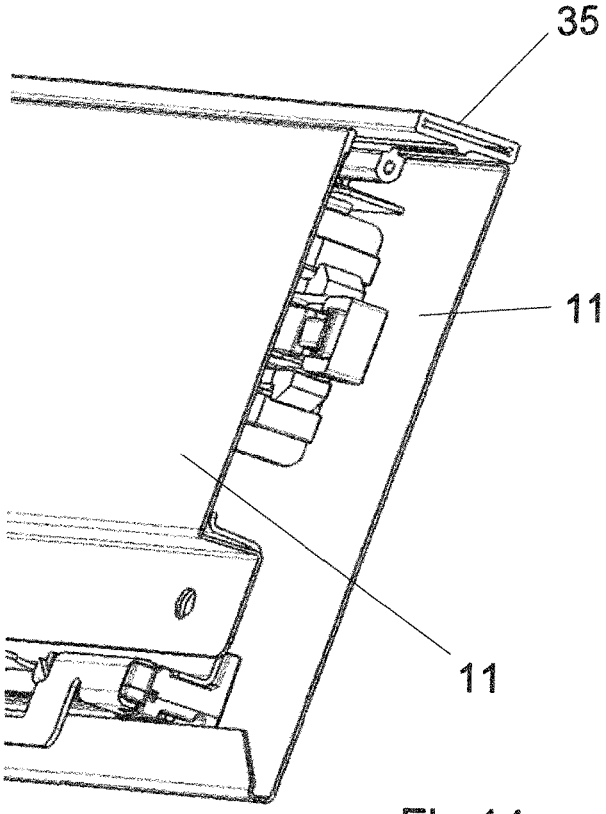
FIG. 14 shows a perspective view of a frame with a cover strip with a recess.
Figure 15:
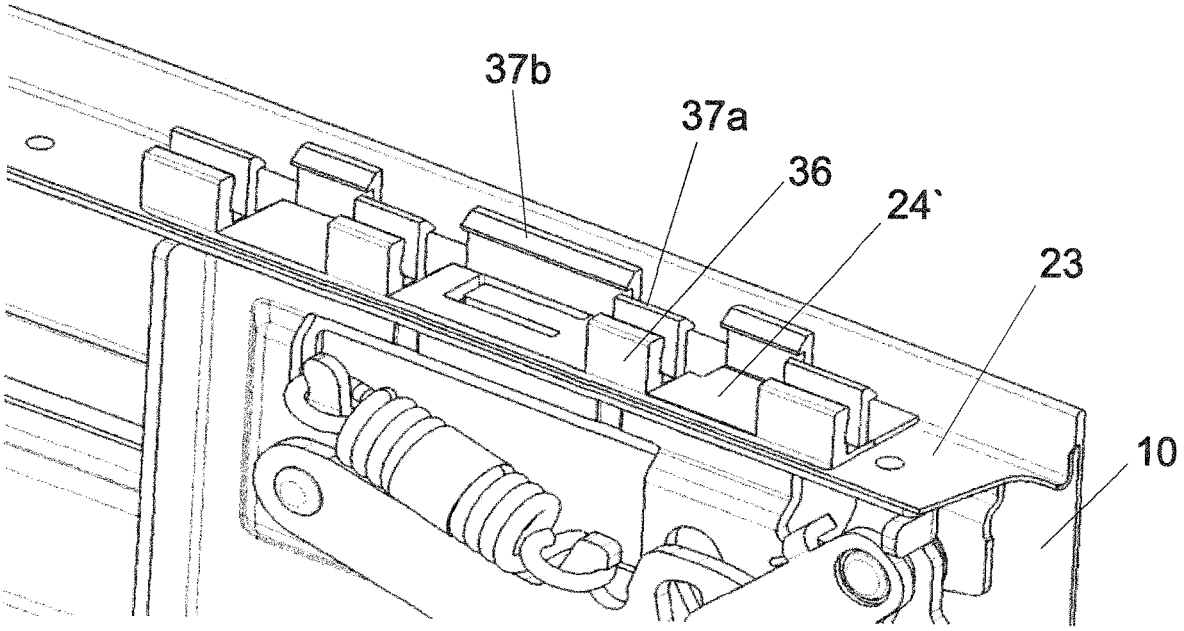
FIG. 15 shows a perspective view of an edge section of an inner shell with an upper guide element.

According to one variant—see FIG. 13 ff—a further component is provided on the shell of frame 1. This component is a cover strip 35.

When assembled, this cover strip 35 visually closes off the inner shell 10 from the outer shell 11 and thus replaces the upper horizontal web 18 of the outer shell 11. The cover strip has a recess towards the rear panel 12*a* (with the width B of the rear panel 12*a*).

The cover strip 35 offers the advantage of being a decorative strip in the same way as a frame, in that it can easily be used to provide other optical and functional variants of the frame or frames without having to fundamentally change the structure of the frame. It is thus possible to provide different colored and/or differently shaped cover strips 35 in order to be able to change the design of the frame upwards in a simple way to suit the individual customer and/or in order to be able to realize attachments or the like on the frame in a simple way. The decorative strip complements the inner shell 10 and the outer shell 11 as compared to FIG. 3 (two-part shell) to form a shell that can also be described as a three-part shell.

In this case, it can be provided that the upper edge 16 of the outer shell 11 may still be converted into a kind of guide groove 17, but into a narrower upper guide groove 17, in which the first upper guide webs 36 of the upper guide elements 24' engage.

Further guide webs 37*a, b* on the upper guide elements 24' can be formed on the upper guide elements 24', in which one or more webs 39 of the cover strip 35 can engage, so that said strip is also slidably guided on the inner shell 10. The guide webs 37*a, b* can also be spring-loaded so that when the web 39 is pushed vertically to the drawer bottom, they move out of the way. The guide webs can also form a type of dovetail guide groove 38 and the web 39 can be formed in a dovetail-like manner. The guide elements 24' thus have the advantage of performing a double function for guiding both the outer shell 11 relative to the inner shell 10 and for guiding the cover strip 35 on the outer shell 11 or on the inner shell 10.

The guide elements 24 and 24' thus each have a base on which one or more of the guide webs (36, 37*a*, 37*b*) are formed.

It is advantageous if the inner shell 10, with the exception of the guide elements 24', is constructed identically to the design variant of FIGS. 1 to 12, so that further variants of frames can be provided or converted to such by virtually simply exchanging the upper guide elements 24 for the other guide elements 24' and providing the other outer shell 11 and the cover strip 35.

Figure 18A:
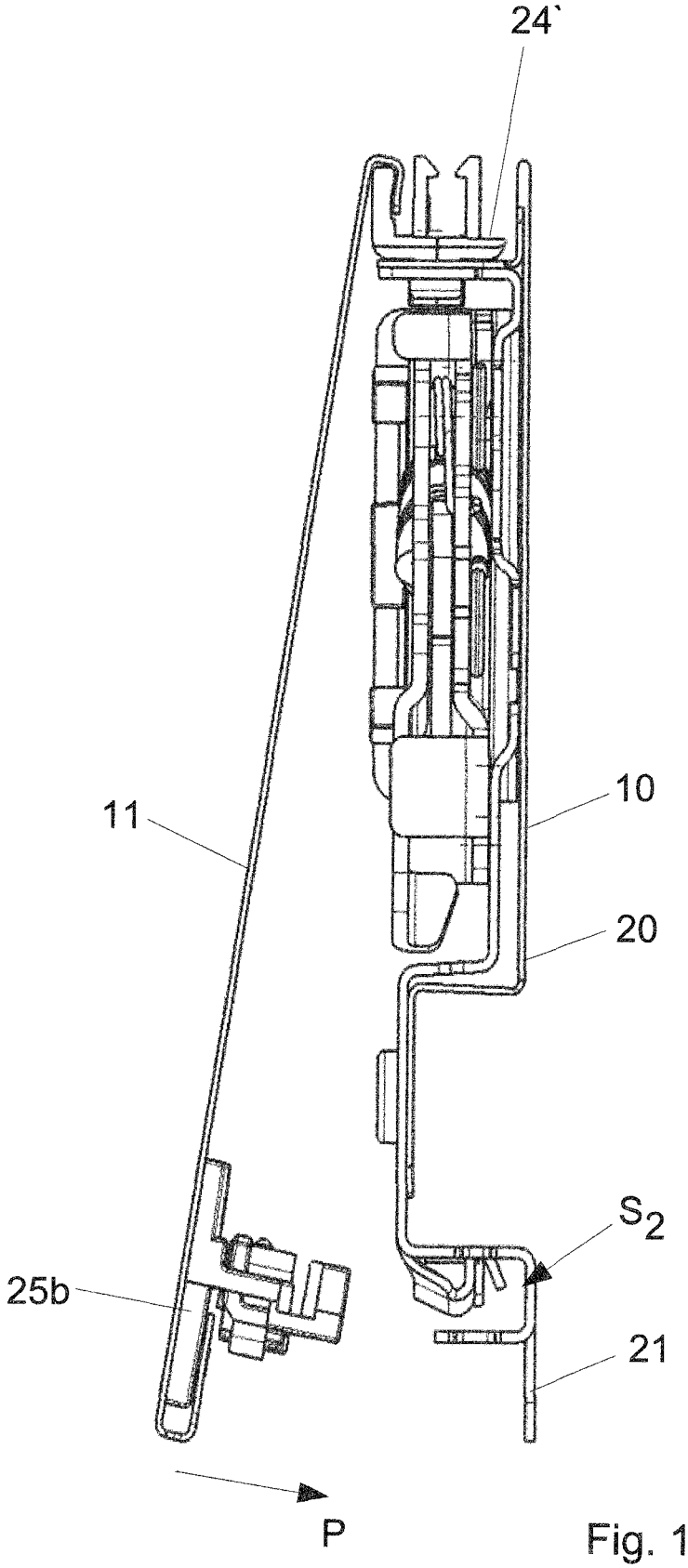
FIG. 18 shows in a) to b) views to illustrate an assembly of an outer shell to an inner shell in steps.
Figure 18B:
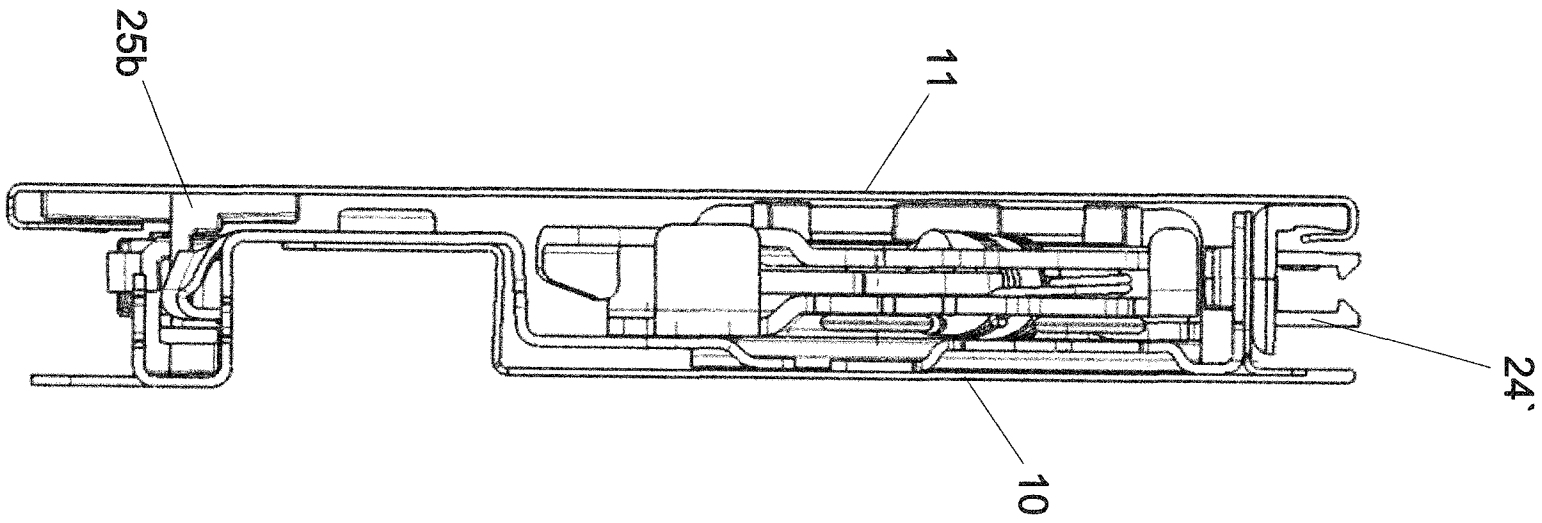

FIGS. 18*a* and *b* illustrate that for assembly the outer shell 11 with the upper guide groove 17 is placed on the guide elements 24'. Then the outer shell 11 with the lower guide elements 25*a* of the first type attached thereto is pivoted towards the inner shell 10 and fixed there (arrow P in FIG. 18*a*).

Figure 19:
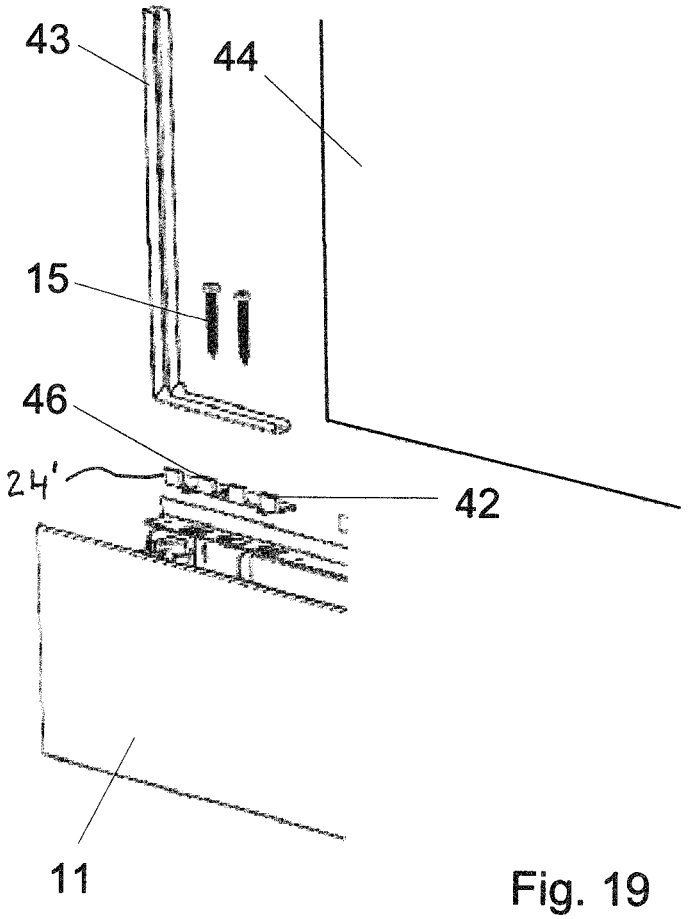
FIG. 19 shows a schematic view of a further variant of a three-part shell of a frame together with further components of this frame.

FIG. 19 shows that on one or more of the upper guide elements 24 positioning and/or fastening means 42 are further provided for easy positioning and/or fastening of a top element. Here the top element is an angle element 43 by way of example. This angle element 43 is in turn designed to hold a wall element, in particular a pane 44.

In a further edge area, the pane 44 is held by another of the angle elements 43 on another of the guide elements (not shown here). The angle element/angle profile 43 on the guide element 24 and/or on the cross beam underneath can be connected to the inner shell 10 or outer shell 11, for example, by a screw, rivet or adhesive connection, on which upper webs 46 serve as a positioning aid for the angle element 43 and again also as webs which form part of the sliding guide S1, on which the outer shell 11 is displaceably guided.

The invention claimed is:

1. A frame for a drawer, comprising:

an outer shell and an inner shell, wherein the outer shell is displaceably guided relative to the inner shell by at least two sliding guides, wherein at least one of the at least two sliding guides has at least one guide element arranged between the outer shell and the inner shell;

wherein one of the sliding guides is a first lower sliding guide between the inner shell and the outer shell and another of the sliding guides is a second lower sliding guide between the inner shell and the outer shell; and wherein first and second types of lower guide elements are distributed between the inner shell and the outer shell, wherein the lower guide elements of the first type are associated with the first lower sliding guide, and wherein the lower guide elements of the second type are associated with the second sliding guide.

2. A frame according to claim 1, wherein a further one of the sliding guides is an upper sliding guide.

3. A frame according to claim 2, comprising at least two different forms of upper guide element for the upper sliding guide, which are interchangeably attachable to the inner shell.

4. A frame according to claim 3, wherein sliding guide means are formed on one or more of the upper guide elements, on which a cover strip with corresponding sliding guide means is slidably guided.

5. A frame according to claim 4, wherein the upper guide elements have webs which form at least one of first and second sliding guide means.

6. A frame according to claim 2, wherein one or more sliding or positioning means for fastening or positioning a top element are formed on one or more of the upper guide elements.

7. A frame according to claim 6, wherein at least one angle element can be arranged on the sliding or positioning means.

8. A frame according claim 1, wherein each of the lower guide elements is arranged in a receiving channel which is formed between the inner shell and the outer shell and has at least three walls.

9. A frame according to claim 8, wherein two walls of the at least one receiving channel are formed by the inner shell and at least one wall of the receiving channel is formed by the outer shell.

10. A frame according to claim 1, wherein each of the guide elements of the lower sliding guides is fastened to the inner shell or to the outer shell.

11. A frame according to claim 10, wherein the guide elements on the inner shell or on the outer shell engage displaceably in a guide groove of the corresponding one of the outer shell and the inner shell.

12. A frame according to claim 11, wherein the guide groove is formed directly in the outer shell or the inner shell.

13. A frame according to claim 11, wherein the guide groove is formed in a further guide element which is fixed to the corresponding one of the outer shell and the inner shell so that the associated sliding guide is formed between two upper guide elements.

14. A frame according to claim 1, further comprising a device for securing the outer shell against lifting off from the inner shell.

15. A frame according to claim 1, wherein the lower guide elements of the first type are fixed to the inner shell and slidably guided on the outer shell, and wherein the lower guide elements of the second type are fixed to the outer shell and slidably guided on the inner shell.

16. A frame according to claim 1, wherein at least a first type of lower guide means is arranged in one of a front and a rear end region of the frame between the inner shell and the outer shell and secures them in the end region or regions against being pulled apart.

17. A frame according to claim 1, wherein at least one of the outer shell and the inner shell is formed from one or more steel sheets.

18. A frame according to claim 17, wherein one or more guide grooves are formed on at least one of the outer shell and the inner shell by a bending process on the steel sheets.

19. A frame according to claim 1, wherein the guide elements are made of fiber-reinforced plastic.

20. A frame according to claim 1, wherein the inner shell and the outer shell together form a body which is substantially rectangular in cross-section and whose maximum width is less than 15 mm.

21. A frame according to claim 1, wherein the outer shell and the inner shell with the at least two sliding guides are guided displaceably relative to one another to a predetermined extent.

22. A drawer for a piece of furniture having one or more frames according to claim 1.

23. A frame for a drawer, comprising:

an outer shell and an inner shell, wherein the outer shell is displaceably guided relative to the inner shell by at least an upper sliding guide between the inner shell and the outer shell, a first lower sliding guide between the inner shell and the outer shell, and a second lower sliding guide between the inner shell and the outer shell, wherein each of the first lower sliding guide and the second lower sliding guide has one or more guide elements arranged between the outer shell and the inner shell.

* * * * *